US006602167B2

(12) United States Patent
Chen

(10) Patent No.: US 6,602,167 B2
(45) Date of Patent: Aug. 5, 2003

(54) FOLDABLE JOGGING MACHINE

(76) Inventor: James Chen, No. 35, Tun Hi Rd., Chin Chan Li, Sa Lu Chen, Taichung Hsein (TW)

( * ) Notice: Subject to any disclaimer, the term of this patent is extended or adjusted under 35 U.S.C. 154(b) by 0 days.

(21) Appl. No.: 09/818,834

(22) Filed: Mar. 28, 2001

(65) Prior Publication Data

US 2002/0142891 A1 Oct. 3, 2002

(51) Int. Cl.[7] ..... A63B 22/02
(52) U.S. Cl. ..... 482/54
(58) Field of Search ..... 482/54

(56) References Cited

U.S. PATENT DOCUMENTS 6,273,842 B1 * 8/2001 Wang et al. ..... 482/54

* cited by examiner

*Primary Examiner*—Nicholas D. Lucchesi
*Assistant Examiner*—Tam Nguyen
(74) *Attorney, Agent, or Firm*—Browdy and Neimark, P.L.L.C.

(57) ABSTRACT

A foldable jogging machine comprises a handrail frame having two bottom rods which are provided in the midsegment with two upright rods and in the front end with a roller. A machine platform has a front end which is located at the bottom of the handrail frame, and a rear end which is provided with at least one roller. Two connection rods are pivoted at one end to the front end of the two bottom rods of the handrail frame, and at other end to the front segment of the machine platform. The machine platform can be turned on the pivoting position of the two connection rods such that the machine platform is rested against the handrail frame.

2 Claims, 3 Drawing Sheets

FOLDABLE JOGGING MACHINE

FIELD OF THE INVENTION

The present invention relates generally to a jogging machine, and more particularly to a foldable jogging machine.

BACKGROUND OF THE INVENTION

As shown in FIG. 1, a prior art jogging machine 80 comprises a front support base 81, a jogging platform 85, and a handrail device 88. The front support base 81 has an inverted U-shaped bottom base portion 82 which is provided in two sides with an upright post 83. These two upright posts 83 are provided in the inner side with a lug 84 extending rearwards. The jogging platform 85 are pivoted at the front two sides with the lugs 84 of the upright posts 83. The handrail device 88 has an inverted U-shaped main body 89 which is pivotally fastened with the jogging platform 85 and is provided with a cross rod for mounting a gauge and is pivoted with a threaded rod 91. The main body 89 turns on the threaded rod 91. The prior art jogging machine 80 can be folded, as shown in FIG. 2.

The prior art jogging machine 80 is complicated in construction. In other words, the jogging platform 85 is pivoted at two sides with the lugs 84 of the front support base 81. The inverted U-shaped main body 89 is pivoted with the threaded rod 91. In light of many component parts, the assembly of the prior art jogging machine 80 is not easy.

SUMMARY OF THE INVENTION

The primary objective of the present invention is to provide a foldable jogging machine which is simple in construction and can be easily assembled.

The foldable jogging machine of the present invention comprises a handrail frame, a machine platform, and two connection rods. The handrail frame has two bottom rods which are parallel to each other and are provided in the midsection with two upright rods and in the front end with a roller. The front end of the machine platform is located at the bottom portion of the handrail frame. The rear end of the machine platform is provided with at least one roller. The connection rods are pivoted at one end to the inner side of the front end of the two bottom rods, and at other end to the front segment of the machine platform. The machine platform can be folded on the pivoting position of the two connection rods such that the machine platform is rested on the handrail frame.

DETAILED DESCRIPTION OF THE INVENTION

Figure 1:
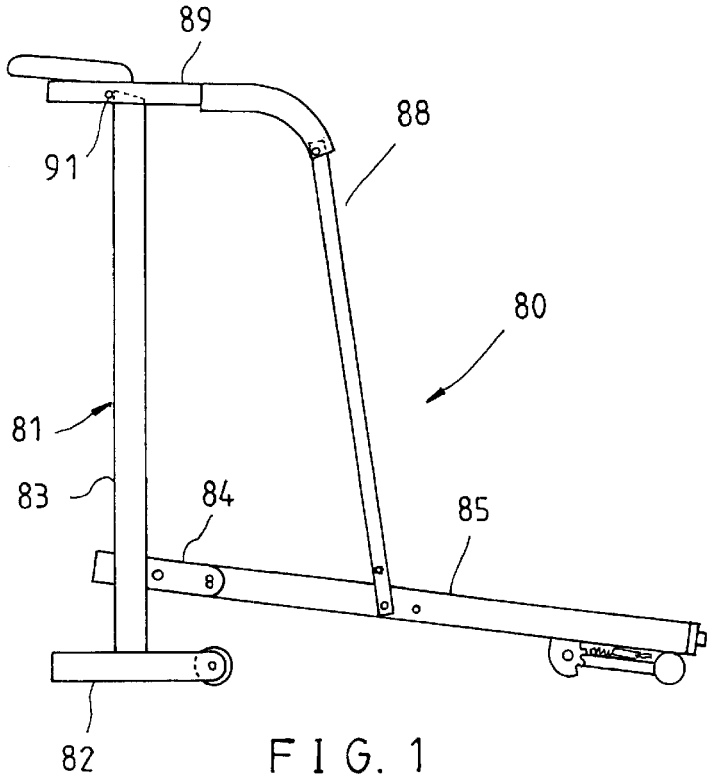
FIG. 1 PRIOR ART
FIG. 1 shows a perspective view of a foldable jogging machine of the prior art.
Figure 2:
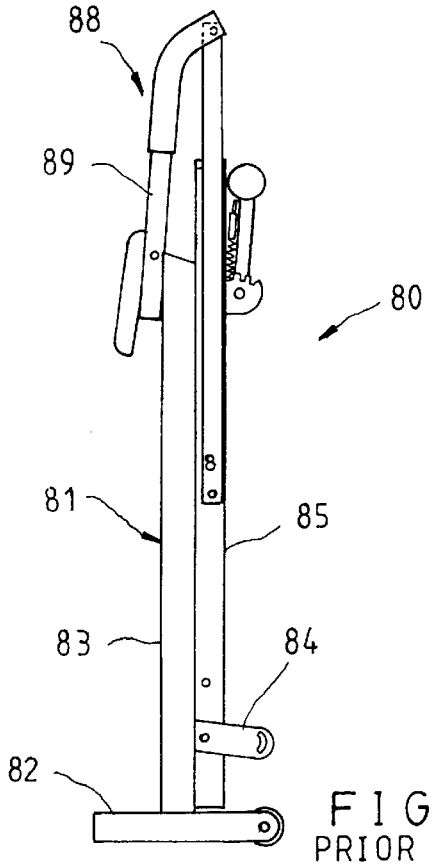
FIG. 2 PRIOR ART
FIG. 2 shows a schematic view of the folded jogging machine of the prior art.
Figure 3:
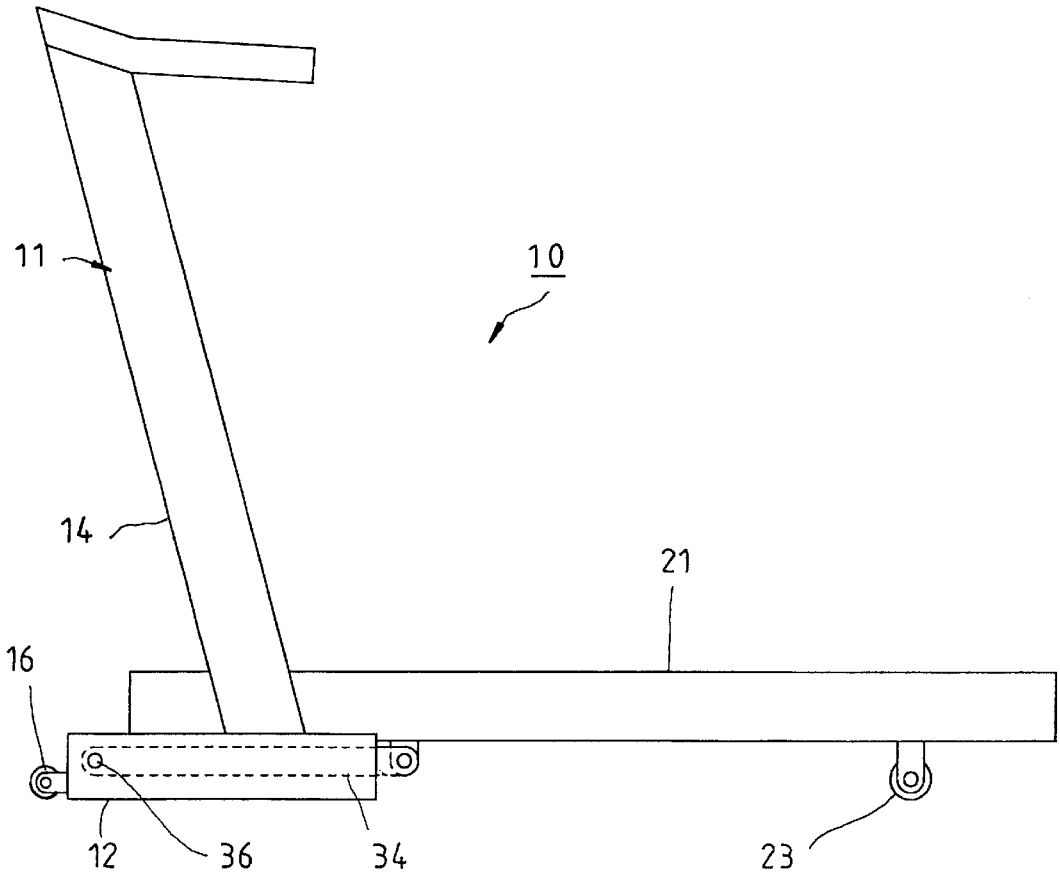
FIG. 3 shows a side view of a preferred embodiment of the present invention.
Figure 4:
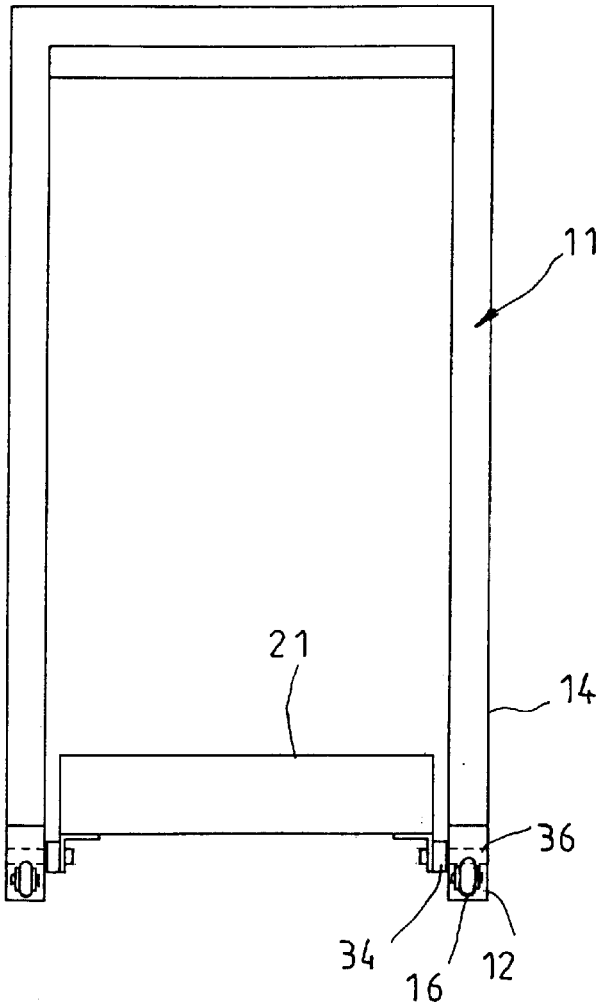
FIG. 4 shows a front view of the preferred embodiment of the present invention.

As shown in FIGS. 3 and 4, a foldable jogging machine 10 of the preferred embodiment of the present invention comprises a handrail frame 11, a machine platform 21, and two connection rods 34.

The handrail frame 11 is provided in the bottom with two parallel bottom rods 12 which are provided in the midsection with two upright rods 14, and in the front end with a roller 16.

The machine platform 21 has a front end which is located at the bottom of the handrail frame 11, and a rear end which is provided in two sides with a roller 23.

The two connection rods 34 are pivoted at one end to the inner side of the front end of the two bottom rods 12 of the handrail frame 11 by a pin 36, and at other end to the front segment of the machine platform 21.

Figure 5:
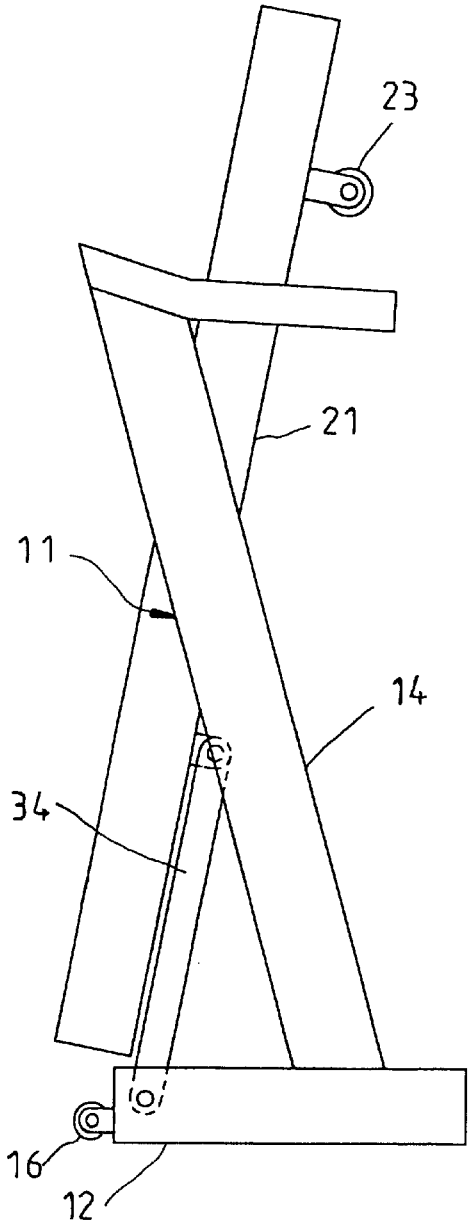
FIG. 5 shows a schematic view of the preferred embodiment of the present invention in action.

As shown in FIG. 5, the machine platform 21 is first lifted and then turned on the pivoting position located between the connection rods 34 and the bottom rods 12. Thereafter, the machine platform 21 is rested on the handrail frame 11. The folded machine can be moved on the rollers 16. The folded machine is unfolded by swiveling downward the machine platform 21 from the position at which the machine platform 21 is rested against the handrail frame 11, so as to enable the rollers 23 of the machine platform 21 to come in contact with the ground surface. The jogging machine 10 is thus put back to remain in the state as shown in FIG. 3.

The feature of the present invention includes the connection rods 34 by which the machine platform 21 is connected with the front end of the bottom of the handrail frame 11. The machine platform 21 is folded on the connection position serving as a swiveling axis. As the jogging machine 10 is folded, the handrail frame 11 can be lifted such that the rollers 16 come in contact with the ground surface. The present invention is simple in construction and is formed of fewer component parts. The connection rods are disposed under the machine platform such that the connection rods connect between the machine platform and the handrail frame.

What is claimed is:

1. A foldable jogging machine consisting of:

a handrail frame having two bottom rods which are parallel to each other and two upright rods respectively engaged at a midsegment of the bottom rods;

a roller rotatably engaged to a front end of each of the two bottom rods;

a machine platform having a front end and a rear end, the machine platform being located at a bottom of said handrail framer and between the two upright rods;

one roller rotatable engaged to the rear end of the machine platform; and two connection rods each having a first end rotatably engaged respectively at a first fixed point on an inner side of the front end of said two bottom rods and a second end rotatabley engaged respectively at a second fixed point on a front segment of said machine platform, wherein said machine platform is manually rotatable on the first fixed point of said two connection rods so that said machine platform rests against said handrail frame.

2. The folding jogging machine according to claim 1, wherein the two connection rods are rotatable at the first end at a bottom of said handrail frame on a pin.

* * * * *